US007841892B2

(12) United States Patent
Zhou et al.

(10) Patent No.: US 7,841,892 B2
(45) Date of Patent: Nov. 30, 2010

(54) CABLE ASSEMBLY WITH CONDUCTIVE WIRES NEATLY ARRANGED THEREIN

(75) Inventors: Yi Zhou, ShenZhen (CN); Xue-Nian Wang, ShenZhen (CN); Xian-Kui Shi, ShenZhen (CN); Chung-Yen Yang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/387,082

(22) Filed: Apr. 28, 2009

(65) Prior Publication Data

US 2009/0269972 A1 Oct. 29, 2009

(30) Foreign Application Priority Data

Apr. 28, 2008 (CN) ..... 2008 1 0301377

(51) Int. Cl.
*H01R 3/00* (2006.01)

(52) U.S. Cl. ..... 439/490; 439/76.1; 439/455

(58) Field of Classification Search ..... 439/490, 439/76.1, 455, 493
See application file for complete search history.

(56) References Cited

U.S. PATENT DOCUMENTS 5,067,903 A * 11/1991 Szyszkowski ..... 439/55
5,244,409 A * 9/1993 Guss et al. ..... 439/490
6,290,538 B1 * 9/2001 Pocrass ..... 439/578
6,572,402 B2 * 6/2003 Lin ..... 439/490
6,979,223 B2 * 12/2005 Chen ..... 439/490
7,275,937 B2 * 10/2007 Ellison ..... 439/67
7,393,237 B2 * 7/2008 Kuo ..... 439/490
2009/0004909 A1 * 1/2009 Puzio et al. ..... 439/460
2009/0233487 A1 * 9/2009 Zhou et al. ..... 439/626
2009/0280675 A1 * 11/2009 Zhou et al. ..... 439/391
2009/0280679 A1 * 11/2009 Chang ..... 439/490

* cited by examiner

*Primary Examiner*—T C Patel
*Assistant Examiner*—Harshad C Patel
(74) *Attorney, Agent, or Firm*—Wei Te Chung; Andrew C. Cheng; Ming Chieh Chang

(57) ABSTRACT

A cable assembly comprises a mating member, a print circuit board having two conductive traces, an LED attached to the print circuit board, a cable having a positive wire and a negative wire connected with the mating member, and a pair of contacts respectively corresponding with the positive wire and negative wire. Said positive wire and negative wire respectively has an inner conductor. Each of said contacts defines a catch part connecting the inner conductor and a retaining part locks the print circuit board for electrically connecting said conductive trace.

13 Claims, 5 Drawing Sheets

CABLE ASSEMBLY WITH CONDUCTIVE WIRES NEATLY ARRANGED THEREIN

BACKGROUND OF THE INVENTION

1. Field of the Invention

The present invention generally relates to a cable assembly, and more particularly to a cable assembly with conductive wires neatly arranged therein by means of an individual organizer attached to each of the conductive wires.

2. Description of Related Art

Nowadays, cable assemblies are widely used in an electronic equipment, especially for transmitting power, and the performance of the cable assembly directly impacts on the entire electronic equipment whether can normally run.

CN Patent No. 2376104Y issued to Ye on Apr. 26, 2000 discloses a cable assembly with an LED thereon to indicate the work status thereof whether the power is on or not. Typically, the cable assembly has an insulative housing, a print circuit board received in the housing and having conductive paths, an LED soldered to the print circuit board, a plurality of contacts connected with the print circuit board and the LED, and a plurality of cables soldered to the print circuit board. As the cable assembly mated with the complementary connector, the LED is illuminated to indicate the power is on therebetween.

A related cable assembly can be found in U.S. patent application Ser. No. 12/381,798, which is currently pending before USPTO and assigned to the same assignee as the current application. The cable assembly comprises a mating member, a print circuit board, an LED attached to the print circuit board and a cable having a positive wire and a negative wire connected with the mating member. Said positive wire and negative wire are placed on one surface of the print circuit board, with the LED set on another surface. The positive wire and negative wire each respectively has an inner conductor soldered to a corresponding soldering pad on the one surface of the print circuit board. Conductive traces are defined on the other surface of the print circuit board and connected with the LED, the soldering pads electrically connects with corresponding conductive traces by vias through the print circuit board.

However, the cables are merely soldered on the conductive paths of the print circuit board, the state of above described is more likely to attribute the insecureness therebetween.

Hence, it is desirable to have an improved structure to overcome the above-mentioned disadvantages of the prior art.

BRIEF SUMMARY OF THE INVENTION

Accordingly, the object of the present invention is to provide a cable assembly defining a plurality of improved disposal of cables, a print circuit board and a plurality of contacts for connecting the cable and the print circuit board.

In order to achieve the above-mentioned object, a cable assembly comprises a mating member, a print circuit board having two conductive traces, an LED attached to the print circuit board, a cable having a positive wire and a negative wire connected with the mating member, and a pair of contacts respectively corresponding with the positive wire and negative wire. Said positive wire and negative wire respectively has an inner conductor. Each of said contacts defines a catch part connecting the inner conductor and a retaining part locks the print circuit board for electrically connecting said conductive trace.

Other objects, advantages and novel features of the invention will become more apparent from the following detailed description of the present embodiment when taken in conjunction with the accompanying drawings.

DETAILED DESCRIPTION OF THE INVENTION

Figure 1:
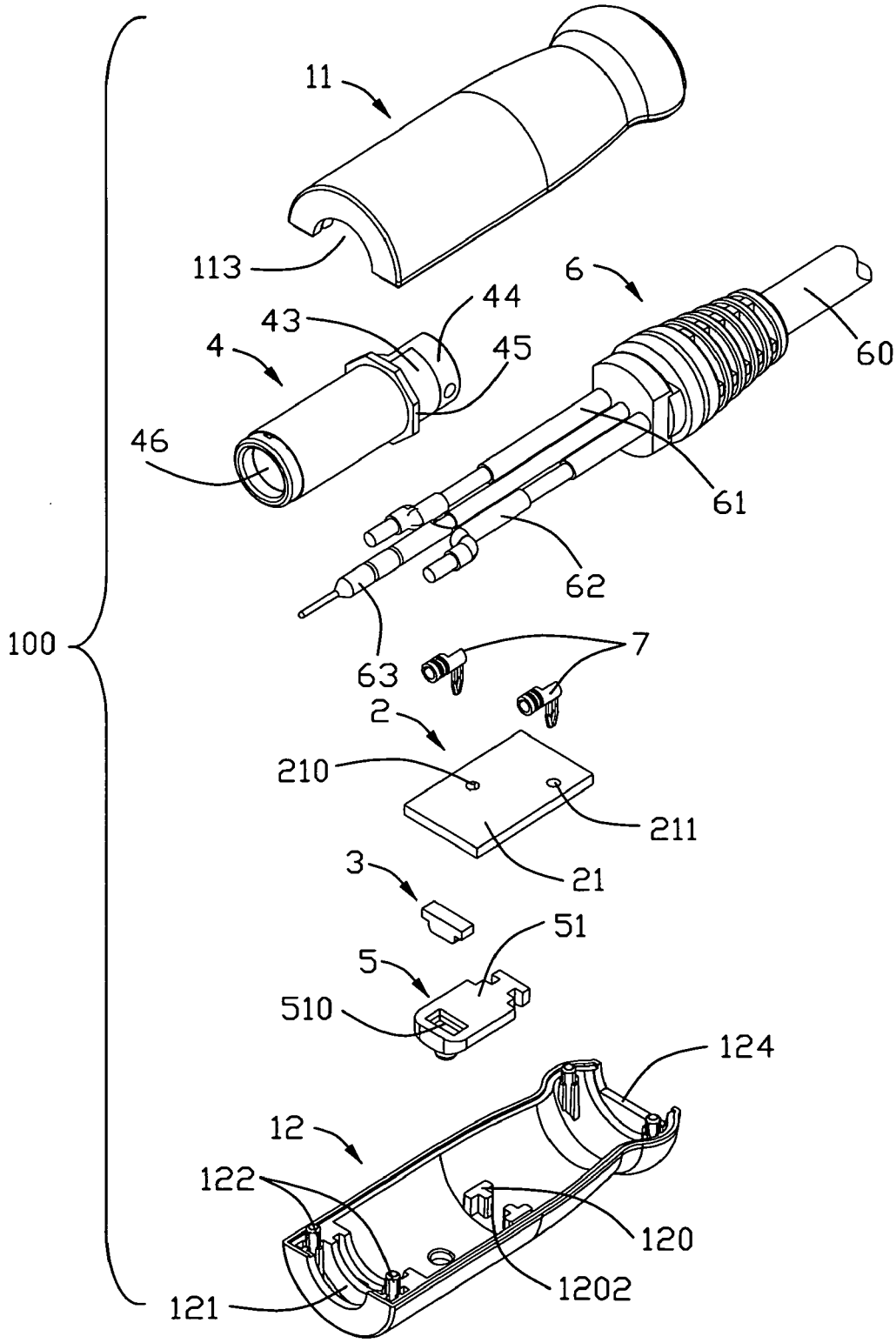
FIG. 1 is an exploded view of the cable assembly in accordance with the present invention.
Figure 2:
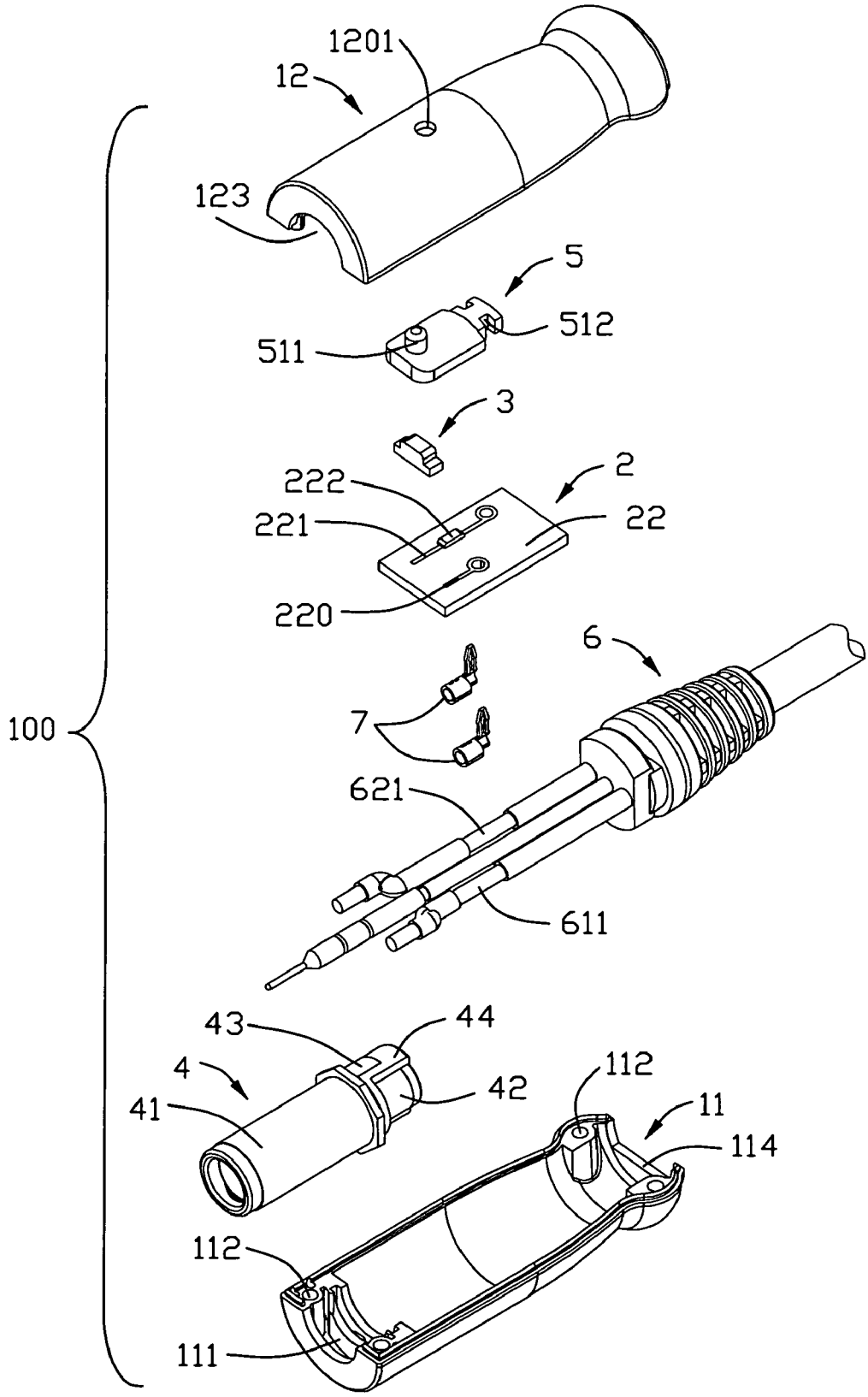
FIG. 2 is a view similar to FIG. 1, but viewed from a different angle.
Figure 3:
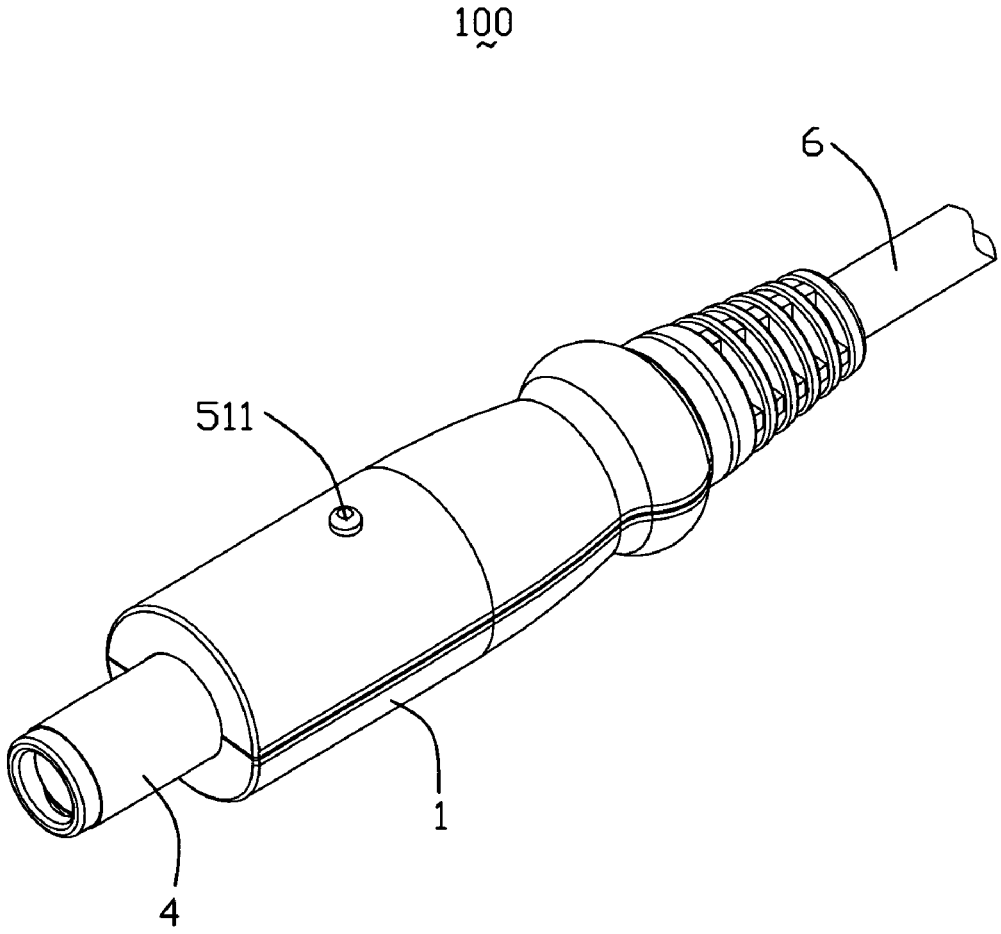
FIG. 3 is an assembled view of a cable assembly.

Reference will now be made to the drawing figures to describe the present invention in detail.

Referring to FIGS. 1-5, a cable assembly 100 made in accordance with the present invention comprises a cylindrical mating member 4, a print circuit board 2, a Light Emitting Diode (LED) 3 assembled to the print circuit board 2, a supporter 5 made of transparent material receiving the LED 3, a cable member 6 with positive wire 61 and negative wire 62, a pair of contacts 7 respectively connecting the wires 61, 62 and the print circuit board 2, and an insulative shell 1 enclosing to the components mentioned formerly.

The insulative shell 1 has a hollowed configuration with a cylindrical shape, and is configured with a top shell 11 and a bottom shell 12. The top shell 11 defines a first cambered groove 111 recessed upwards, a first semicircular hole 113 at front end thereof, and a first cutout 114. A pair of holes 112 is defined in lateral sides of front portion of the top shell 11. The bottom shell 12 is symmetrical to the top shell 11 in shape, and comprises a pair of block portions 120 in the depressed area thereof with a ridge 1202. Additionally, a through hole 1201 is defined on the outer periphery of the bottom shell 12 and locates adjacent to the block portions 120, the through hole 1201 extends through the bottom shell 12 along up-to-down direction. The bottom shell 12 defines a second cambered groove 121 in front-end corresponding to the first cambered groove 111, and a second semicircular hole 123 together with the first semicircular hole 113 to form a circular hole. Furthermore, the bottom shell 12 also has a second cutout 124 matching with the first cutout 114, and a plurality of posts 122 received in the corresponding holes 112.

The print circuit board 2 is configured in rectangular structure, and it defines an upper surface 21 and a lower surface 22, a pair of plated through holes 210, 211 is arranged on the upper surface 21 in staggered relationship. The plated through holes 210, 211 are not in a line along a direction perpendicular to a catch part, and the plated through hole 210 is closer to the front edge of the print circuit board 2 than the plated through hole 211. The lower surface 22 has conductive traces 220, 221 connected to the plated through holes 210, 211 and extended forwards. A resistance 222 is defined on the middle position of the conductive trace 221, and the resistance 222 has a transformer action. The LED 3 has a convex top, and disposed on the print circuit board 2 to form a unitary configuration by surface mount technique (SMT), such that the LED 3 sticks to front part of the lower surface 22 of the print circuit board 2, and electrically connects with the conductive traces 220, 221.

The supporter 5 has a flat base portion 51 with a depression 510 recessed downwards on the front end thereof for receiving the LED 3 therein. A transparent column 511 is functioning as a light pipe and is protruding out of the bottom of the supporter 5 and is aligning with the depression 510. Additionally, the supporter 5 defines an I-shape extension portion 512 in a back end thereof to cooperate with the block portion 120 of the bottom shell 12.

The cable member 6 comprises a cable 60 a positive wire 61 and a negative wire 62 extending forwardly beyond the cable 60, and a detective wire 63 located between the positive wire 61 and negative wire 62. The positive wire 61 and negative wire 62 each respectively has inner conductors 611, 621 with part of the corresponding outer jacket stripped away to a certain length from front end thereof to expose part thereof. The inner conductors 611, 621 that exposed outside are offset from each other. The inner conductors 611, 621 are arranged respectively corresponding to the plated through holes 210, 211.

Figure 4:
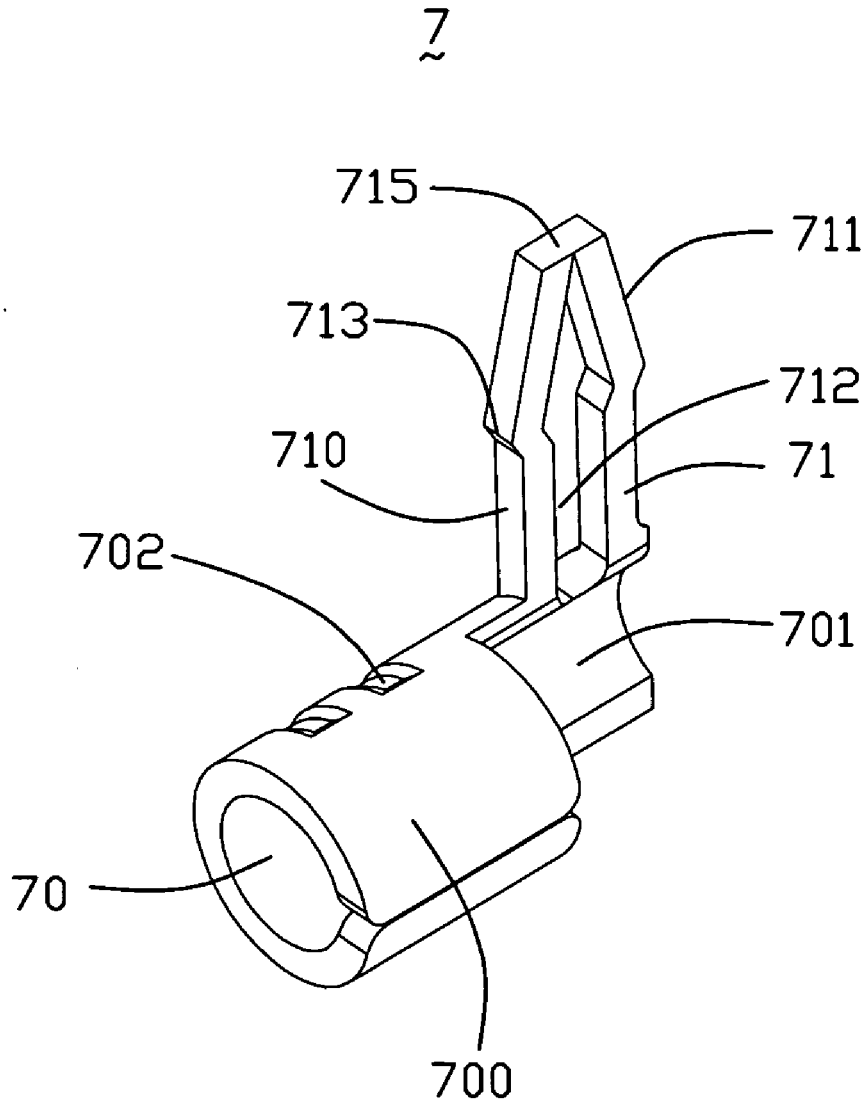
FIG. 4 is a contact view of FIG. 2.
Figure 5:
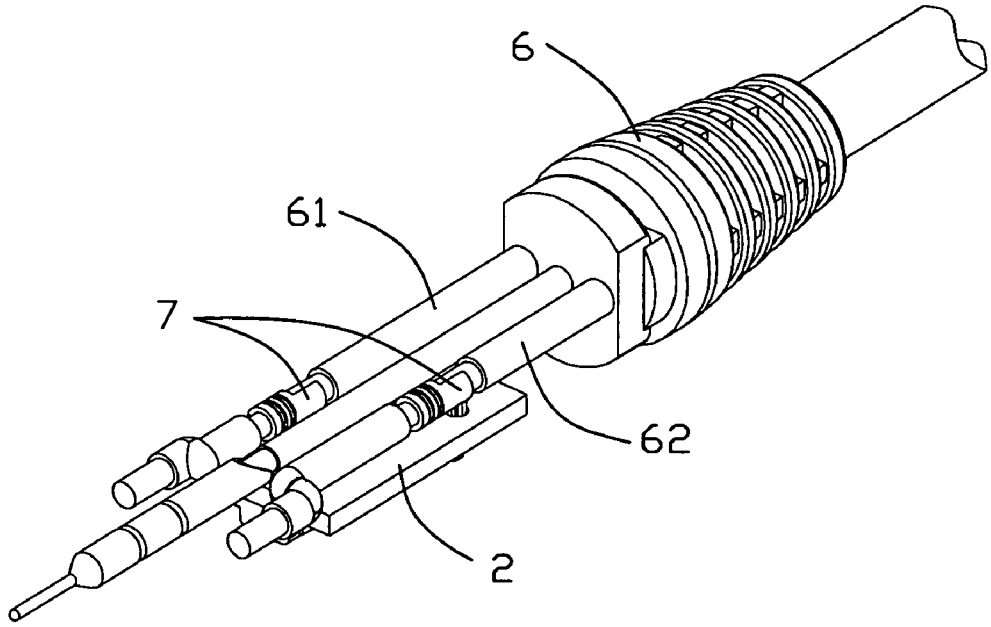
FIG. 5 is a partially assembled view of FIG. 2.

Referring to FIG. 4, the contact 7 is made of conducting material, and defines a convex bodying portion 70 and an arrowheaded structure 71 extending downwardly from a side of the bodying portion 70. The bodying portion 70 defines a cylindrical front-end portion 700 and a cambered back-end portion 701. The front-end portion 700 defines a pair of parallel troughs 702 recessed inward on the outer face thereof. The arrowheaded structure 71 defines a pair of parallel supporting portions 710, a pair of italic portions 711 extending downwardly from the corresponding supporting portions 710, and an arrowheaded slot 712 formed by the supporting portions 710 and the italic portions 711. A flat bottom 715 is formed at the intersection of the italic portions 711. A corner 713 is formed at the intersection of the italic portion 711 and the supporting portion 710.

The cylindrical mating member 4 comprises a hollow mating section 41 in the front end, a polygonal flange 45 surrounding the cylindrical mating member 4, an anode tube 42 located behind the polygonal flange 45 and communicated with an inner wall 46 of the cylindrical mating member 4, and a cathode tube 43 located behind the polygonal flange 45 and isolated from the anode tube 42 by plastic layer 44. The cathode tube 43 is communicated with outer wall of the mating section 41 and has the same polarity with each other. However, in other alternative embodiment, the anode tube 42 and the inner wall 46 may be intergrally formed of one single piece structure, so do the cathode tube 43 and the outer wall of the mating section 41.

In assembly, the inner conductors 611, 621 of the positive wires 61, 62 are wrapped round with the corresponding bodying portions 70 of the contacts 7. The contacts 7 arranged in staggered relationship are corresponding with the conductors 611, 621. Then, the contacts 7 are inserted into the print circuit board 2, the supporting portions 710 of the contacts 7 are received in the corresponding plated through holes 210, 211 respectively; the italic portions 711 extend out of the lower surface 22 of the print circuit board 2; the corners 713 lock the lower surface 22 of the print circuit board 2 through the plated through holes 210, 211. The LED 3 is attached to the lower surface 22 of the print circuit board 2 and electrically connected with the conductive traces 220, 221, and the resistance 222 provides voltage protection for the LED 3. When solder material is used for soldering the contacts 7 and the conductors 611, 621, the solder material will along the arrowheaded structure 71 of the contact 7 to flow into the plated through holes 210, 211 and ultimately connects the conductive traces 220, 221, therefore the cable member 6 achieves connect electrically with the LED 3. Then, the LED 3 is received in the depression 510 of the supporter 5 as an indicator.

Then, cylindrical mating member 4 is electrically connected with the cable member 6, the front end of the positive wire 61 is soldered to the anode tube 42, the negative wire 62 is soldered to the cathode tube 43 with front end, the detective wire 63 extends through an aperture (not shown) in the back end of the cylindrical mating member 4 and enters into the cavity of the cylindrical mating member 4. Finally, the top shell 11 is assembled to the bottom shell 12, the supporter 5 is mounted to the block portions 120 with the I-shape extended portion 512 sliding along the ridge 1202 of the bottom shell 12, and the transparent column 511 is received in the through hole 1201 to indicate the work status of the cable assembly 100. The first cambered groove 111 of the top shell 11 cooperates with the second cambered groove 121 of the bottom shell 12 to receive the polygonal flange 45. The posts 122 of the bottom shell 12 are respectively received in the relevant notches 112, the first cutout 114 of the top shell 11 is cooperated with the second cutout 124 of the bottom shell 12 to receive the front part of the cable 60 of the cable member 6. Thus, the cable assembly 100 is assembled.

In accordance with the embodiment of the present invention, the contacts are used for electrically connecting the cable member 6 and the print circuit board 2, when solder material is used for soldering the contacts 7 and the conductors 611, 621, solder material will flows down to the plated through holes 210, 211 and contacts the conductive traces 220, 221 so as to achieve connect electrically between the cable member 6 and the LED 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a mating member;

a print circuit board having an upper face and a bottom face opposite to the upper face, a pair of plated through holes on said upper face, two conductive traces on said bottom face and each electrically connected to an inner surface of one of said plated through holes;

an LED device on the bottom face and soldered to said conductive traces;

a cable member having a positive wire and a negative wire connected with the mating member, said positive wire and negative wire each having an inner conductor; and a pair of contacts in correspondence with the positive wire and negative wire respectively, each of said contacts having a catch part catching one of said inner conductors, and a retaining part connected to the catch part, said retaining part interferentially and electrically retained in the corresponding plated through holes;

wherein the catch part has a cylindrical front-end portion and a cambered back-end portion, and the front-end portion defines parallel troughs recessed inward on the outer face thereof;

2. The cable assembly as claimed in claim 1, wherein said contacts are arranged in stagger relationship relative to each other.

3. The cable assembly as claimed in claim 1, wherein the retaining part forms an arrowheaded structure, and defines a pair of parallel supporting portions, a pair of italic portions extending downwardly from the corresponding supporting portions, and an arrowheaded slot formed by the supporting portions and the italic portions.

4. The cable assembly as claimed in claim 3, wherein a corner is formed at an intersection of the italic portion and the supporting portion.

5. The cable assembly as claimed in claim 4, wherein the parallel supporting portion is connected to said inner surface of the plated through hole.

6. The cable assembly as claimed in claim 5, wherein partial of outer jackets of the power and negative wire are stripped away to expose the corresponding inner conductors outside.

7. The cable assembly as claimed in claim 1, wherein the LED is mounted to the print circuit board by surface mount technique.

8. The cable assembly as claimed in claim 2, wherein one of plated through holes is closer to front end of the print circuit board than another.

9. The cable assembly as claimed in claim 1, further comprising a supporter, wherein the supporter defines a depression receiving the LED and a transparent column.

10. The cable assembly as claimed in claim 9, further comprising an insulative shell, which comprises a top shell and a bottom shell, a through hole defined in one of the top shell and bottom shell for receiving the transparent column.

11. The cable assembly as claimed in claim 10, wherein a block portion is defined on one of the top shell and bottom shell for retaining the supporter.

12. The cable assembly as claimed in claim 11, wherein the transparent column extends through the through hole.

13. The cable assembly as claimed in claim 12, wherein the mating member is of cylindrical shape and has a flange received in cambered grooves of the insulative shell.

* * * * *